US005141441A

United States Patent [19]

Wallingford

[11] Patent Number: 5,141,441

[45] Date of Patent: Aug. 25, 1992

[54] UNDERWATER BUOYANCY TRAINING OBSTACLE COURSE TARGET HOOP

[76] Inventor: Peter A. Wallingford, 236 SW. 171 St., Seattle, Wash. 98166

[21] Appl. No.: 649,573

[22] Filed: Feb. 1, 1991

Related U.S. Application Data

[63] Continuation-in-part of Ser. No. 556,836, Jul. 23, 1990.

[51] Int. Cl.[5] ..... A63B 69/10; A63B 69/12; A63B 31/00; A63G 31/00

[52] U.S. Cl. ..... 434/254; 472/128; 482/55

[58] Field of Search ..... 434/254; 272/1 B, 71; 273/181 R; 441/1, 21, 24

[56] References Cited

U.S. PATENT DOCUMENTS

| | | | |
|---|---|---|---|
| 3,095,197 | 6/1963 | Weitzman | 272/1 B |
| 3,323,795 | 6/1967 | Quello | 272/1 B |
| 3,329,425 | 7/1967 | Gieseler | 272/1 B |
| 3,826,494 | 7/1974 | Wainwright et al. | 273/1 R |
| 3,832,746 | 9/1974 | Korsgaard | 441/24 |
| 3,878,576 | 4/1975 | Suyderhoud | 441/6 |
| 3,895,801 | 7/1975 | Baird | 273/95 R |
| 4,107,804 | 8/1978 | Bennett | 441/24 |
| 4,707,869 | 11/1987 | Ray | 4/505 |

FOREIGN PATENT DOCUMENTS

| | | | |
|---|---|---|---|
| 2235713 | 1/1975 | France | 272/1 B |

OTHER PUBLICATIONS

Leslie's Mail Order Presents, "Loops 'n Angles".

*Primary Examiner*—Gene Mancene
*Assistant Examiner*—Cindy A. Cherichetti
*Attorney, Agent, or Firm*—John R. Flanagan

[57] ABSTRACT

An underwater obstacle course target hoop for use in underwater buoyancy training includes a plurality of hollow tubular members having open opposite ends, a plurality of connector members interfitted with all but two adjacent opposite ends of the tubular members, and a pair of separate end caps respectively attached to and interfitted with the two adjacent ends of the adjacent pair of the tubular members so as to define an escape gap between the two adjacent ends of the tubular members for preventing entanglement of a diver with the hoop. The tubular members and connector members define upper and lower portions of the target hoop. The tubular members of the lower portion of the hoop contain a plurality of apertures for permitting entry of water into the lower portion of the hoop when submerged in water. An elastic cord can be employed within the interfitted tubular and connector members which is sufficiently stretchible to retain the members in interfitted relation but permit the members to be pulled apart and the hoop thereby collapsed into a compact stack for transport and storage.

15 Claims, 5 Drawing Sheets

UNDERWATER BUOYANCY TRAINING OBSTACLE COURSE TARGET HOOP

CROSS-REFERENCE TO RELATED APPLICATION

This application is a continuation-in-part of copending U.S. patent application Ser. No. 556,836, pending filed Jul. 23, 1990, entitled "Underwater Buoyancy Training Obstacle Course Target Set, Kit And Layouts" by Peter A. Wallingford.

BACKGROUND OF THE INYENTION

1. Field of the Invention

The present invention generally relates to underwater diving training and, more particularly, is concerned with an underwater obstacle course target hoop for use in buoyancy training.

2. Description of the Prior Art

Underwater diving, also known as scuba diving, has been a popular recreational sport for persons from many segments of the general public for a long time. It requires more skills than just the ability to swim underwater. Underwater diving requires the wearing and operating of relatively heavy and cumbersome equipment simultaneously as one controls body buoyancy level and coordinates the body movements necessary to move from from one depth to another. Skill in controlling body bouyancy is a prerequisite to being able to navigate safely and unintrusively near and over fragile underwater environments such as coral reefs.

As the popularity of underwater diving continues to grow, a primary problem faces the diving industry, namely, effective training of consistent buoyancy skills among sport divers. The present lack of consistency in this skill area affects diver safety and threatens the very existence of coral reefs at popular underwater diving destinations around the world. This lack of consistency has prevailed in the industry despite recognition that practice of buoyancy skills are essential as evidenced by the fact that limited training does take place. One training technique which has been used heretofore is for divers to swim through one or more buoyant circular hoops suspended off the bottom of a body of water by fixedlength weighted belts typically worn by divers.

What has made the training of consistent buoyancy skills a difficult problem in the past is the prevailing view that the particular skill level of a given certified underwater diver must be determined first. A diver will already possess certification documents evidencing completion of the necessary training to participate in underwater diving. However, buoyancy control skills decline the longer a diver remains inactive. Thus it is important to know how long ago it was that a given certified diver participated in underwater diving. There is no generally accepted and enforced logbook used in the diving industry, similar to what is used in the private flying industry, to show how frequently and recently a given diver participated in underwater diving. Testing or questioning every diver each time he or she prepares to engage in underwater diving creates ill-will and is not an effective nor workable solution.

As a consequence, a pressing need exists for a more systematic and non-confrontation approach to overcoming this difficult problem.

SUMMARY OF THE INvENTION

The present invention provides an improved target hoop for use in conjunction with an underwater buoyancy training course designed to satisfy the aforementioned needs. Target sets, kits and layouts for the underwater buoyancy training course are the subject of the patent application cross-referenced above, the disclosure of which is incorporated herein by reference. The target hoop of the present invention provides improvements which assist a divemaster or instructor in transporting target hoops and establishing the correct buoyancy of the target hoops at the site of the underwater buoyancy training course.

Accordingly, the present invention is directed to an underwater obstacle course target hoop for use in underwater buoyancy training. The target hoop includes: (a) a plurality of hollow tubular members, each tubular member having open opposite ends; (b) a plurality of connector members interfitted with all but two adjacent opposite ends of the tubular members; and (c) a pair of separate end caps respectively interfitted with and attached to the two adjacent opposite ends of an adjacent pair of the tubular members so as to define an escape gap between the two adjacent opposite ends of the tubular members for preventing entanglement of a diver with the hoop. The tubular members and connector members define upper and lower portions of the hoop, with the tubular members of the lower portion of the hoop containing a plurality of apertures for permitting entry of water into the lower portion of the hoop when submerged in water. An elastic cord can be employed within the interfitted tubular and connector members which is sufficiently stretchible to retain the members in interfitted relation but permit the members to be pulled apart and the hoop thereby collapsed into a compact stack for transport and storage.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

Figure 1:
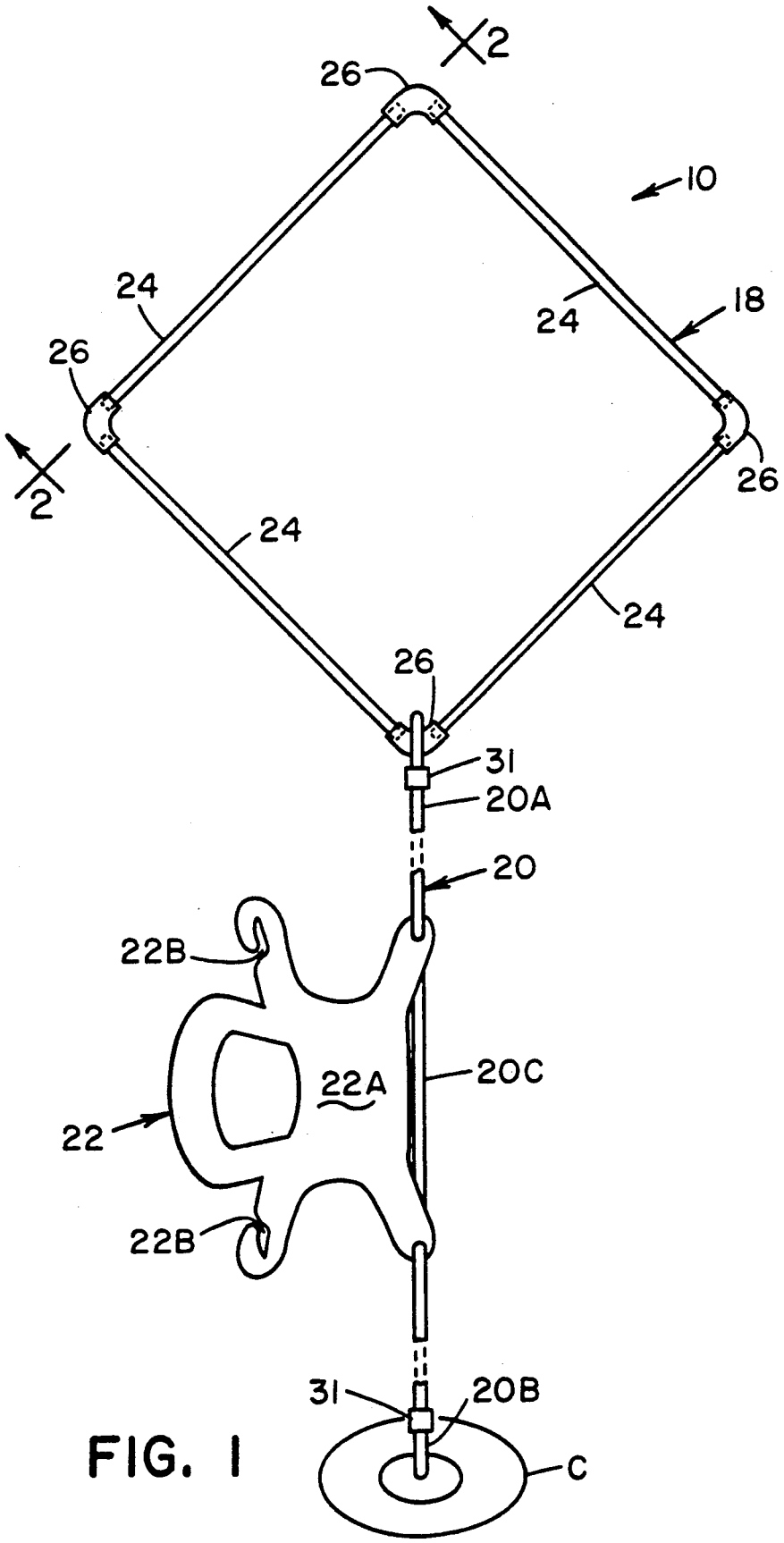
FIG. 1 is an end elevational view of a target set employed in an underwater buoyancy training obstacle course in accordance with the invention of the cross-referenced application, illustrating a preferred diamondshaped target hoop of the target set.
Figure 2:
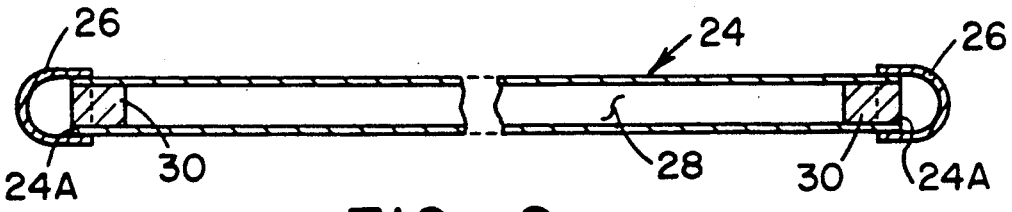
FIG. 2 is an enlarged foreshortened longitudinal sectional view taken along line 2—2 of FIG. 1 showing one of the tube members of the diamond hoop with a pair of elbow members of the hoop attached on opposite ends of the tubular member.
Figure 3:
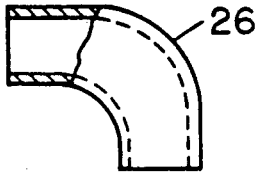
FIG. 3 is an enlarged side elevational view of one of the elbow members of the target set of FIG. 1.

Fiq. 9 is an end elevational view of an alternative rectangular hoop which can be substituted in place of the diamond hoop of the target set of FIG. 1.

Figure 10:
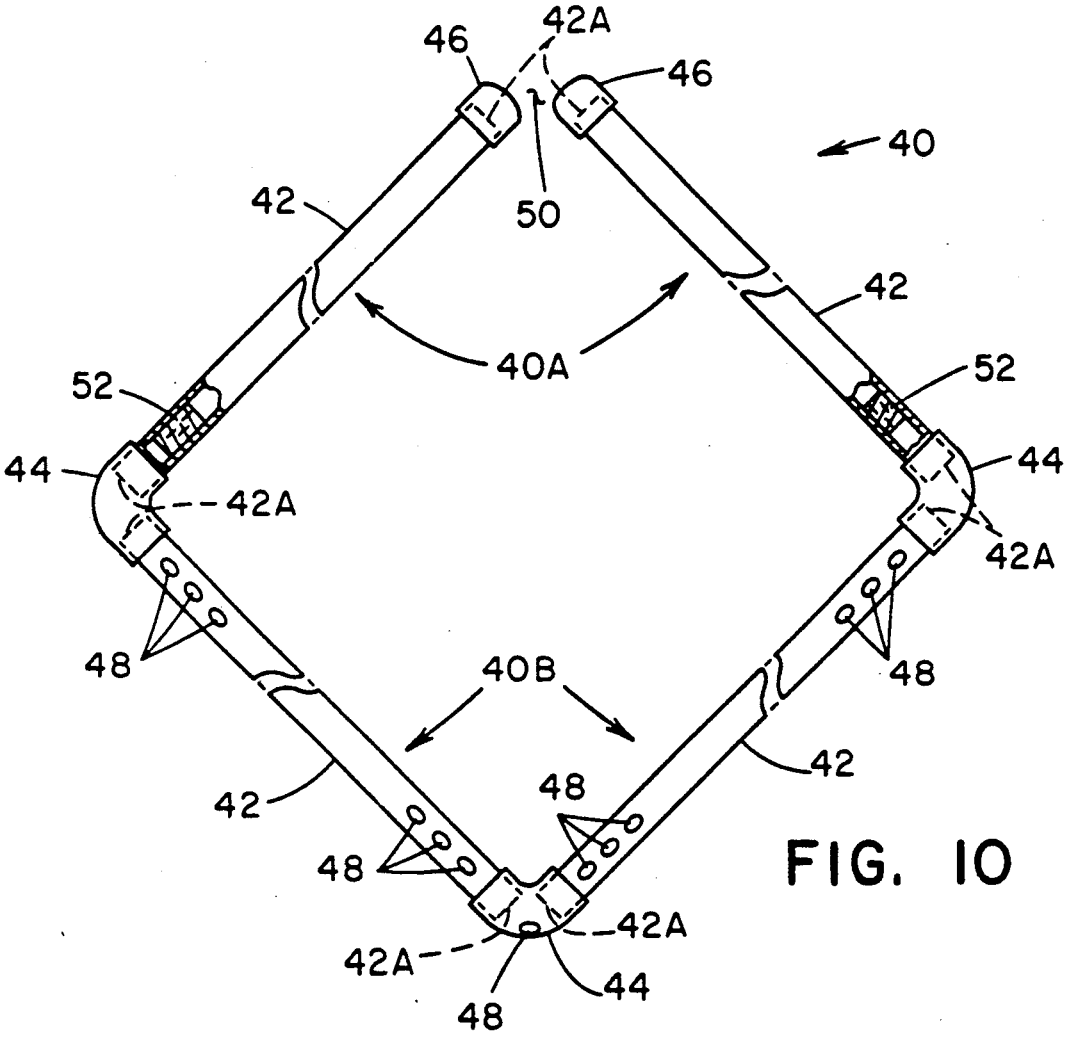

FIG. 10 is an end elevational view of an improved diamond-shaped target hoop which can be substituted in the target set of FIG. 1, this improved target hoop having a construction in accordance with the present invention.

Figure 11:
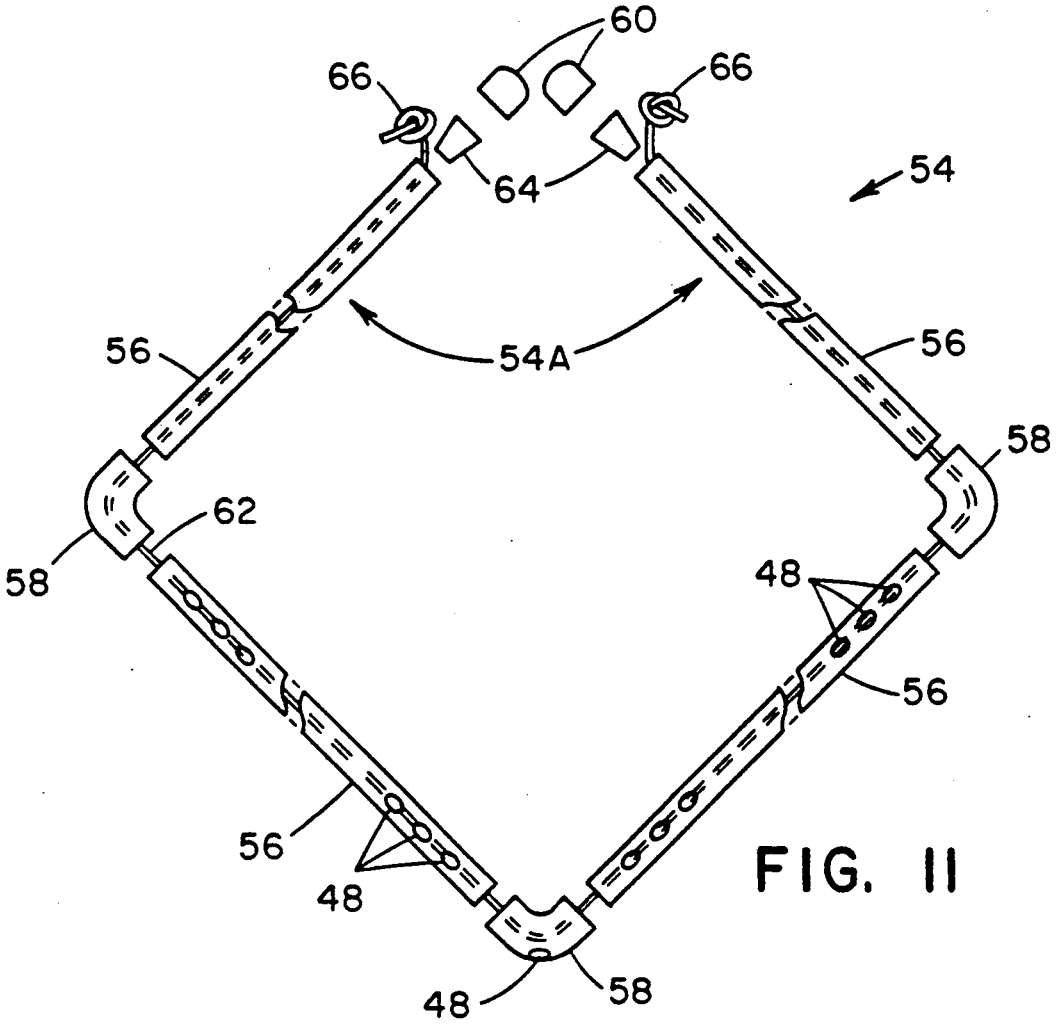

FIG. 11 is an end elevational view of another improved diamond-shaped target hoop which can be substituted in the target set of FIG. 1, this improved target hoop also having a construction in accordance with the present invention.

Figure 12:
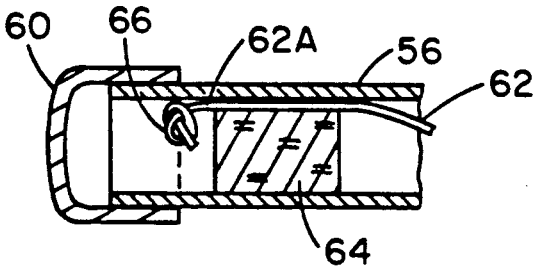

FIG. 12 is an enlarged fragmentary sectional view of the improved target hoop of FIG. 11.

Figure 13:
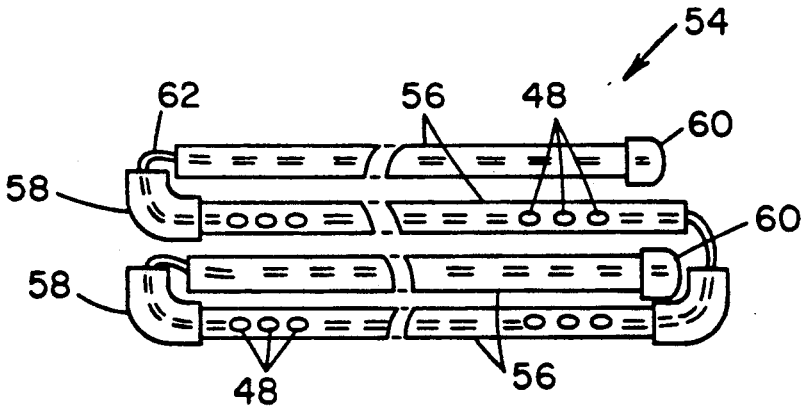

FIG. 13 is an elevational view of the target hoop of FIG. 11 being illustrated in broken down form suitable for packing and transporting.

DETAILED DESCRIPTION OF THE INVENTION

Referring to the drawings, and particularly to FIG. 1, there is shown an underwater obstacle course target set in accordance with the invention of the cross-reference application, being generally designated 10. A plurality of such target sets 10, for example five of such sets, is employed in setting up an underwater obstacle course which can assume any one of a number of different underwater buoyancy training obstacle course layouts also in accordance with the invention of the cross-referenced application.

In its basic components, the underwater obstacle course target set 10 includes a target hoop 18, a line cord 20, and a line holder 22. The target hoop 18 has a buoyancy sufficient to allow it to undergo upward floating movement toward a surface A of a body of water B, such a body of relatively quiet, safe ocean water. The line cord 20 can be any suitable flexible elongated tethering-type device having one end portion 20A adapted for attachment to the target hoop 18. The line cord 20 also has an opposite end portion 20B adapted for attachment to an object C, such as a weight or rock, resting on a bottom D of the body of water B, and an intermediate portion 20C extending between opposite end portions 20A and 20B being attached to the line holder 22 and capable of being selective wrapped or wound about the line holder 22 to adjust the effective length of the line cord 20. The object C must be able to anchor the target hoop 18 via line cord 20 and thus must have sufficient weight to resist the upward floating movement of the target hoop 18 toward the surface A of the body of water B. An object C, such as a lead weight, ranging from three to four pounds in weight is recommended.

The line holder 22 of the target set 10 is attached to the line cord 20 and has a portion 22A for receiving and storing a selected length of the intermediate portion 20C of the line cord 20 extending between the opposite end portions 20A, 20B thereof. The desired amount of line cord 20 can be stored on the line holder 22 by wrapping it about the storing portion 22A and then inserting and catching portions of the line cord 20 within tapered notches 22B in the line holder 22. In such manner, the line cord 20 is provided with a desired overall length from the bottom D of the body of water B to the target hoop 18 for maintaining the target loop 18 floating underwater at a desired height above the bottom D of the body of water B (or desired depth below the body of water surface A).

In the preferred embodiment of the target set 10 shown in FIG. 1, the target hoop 18 is of square- or diamond-shape configuration. The target hoop 18 is composed of a plurality of elongated straight hollow tubular members 24 having oipen opposite ends 24A, and a plurality of connecting corner members 26 interfitted with and attached to the opposite ends 24A of the tubular members 24. The straight tubular members 24 can be plastic tubes and the connecting members 26 can be right angle plastic elbows. The connecting members 26 can be attached to the straight tubular members 24 in any suitable manner such as by cementing them together.

Before assembling of the members 24, 26 together, hollow itneriors 28 of the hollow tubular members 24 are sealed by insertion of plugs 30 into the iopen opposite ends 24A of the members 24 so as to capture air in the interior 28 and prevent water from entering for providing the desired buoyancy to the target hoop 18. The hollow tubular members 24 can be clear plastic tubes so that various forms of light can be housed within the interiors 28 thereof to illuminate the hoop 18 for night and low visibility conditions.

Figure 4:
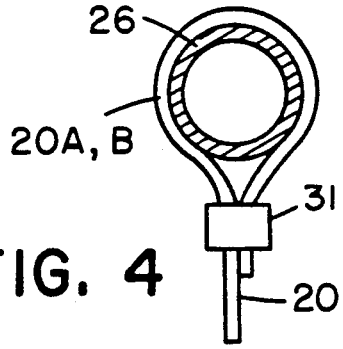
FIG. 4 is an enlarged fragmentary cross-sectional view showing the one elbow member of the diamond loop about which is attached a line cord of the target set of FIG. 1.
Figure 5:
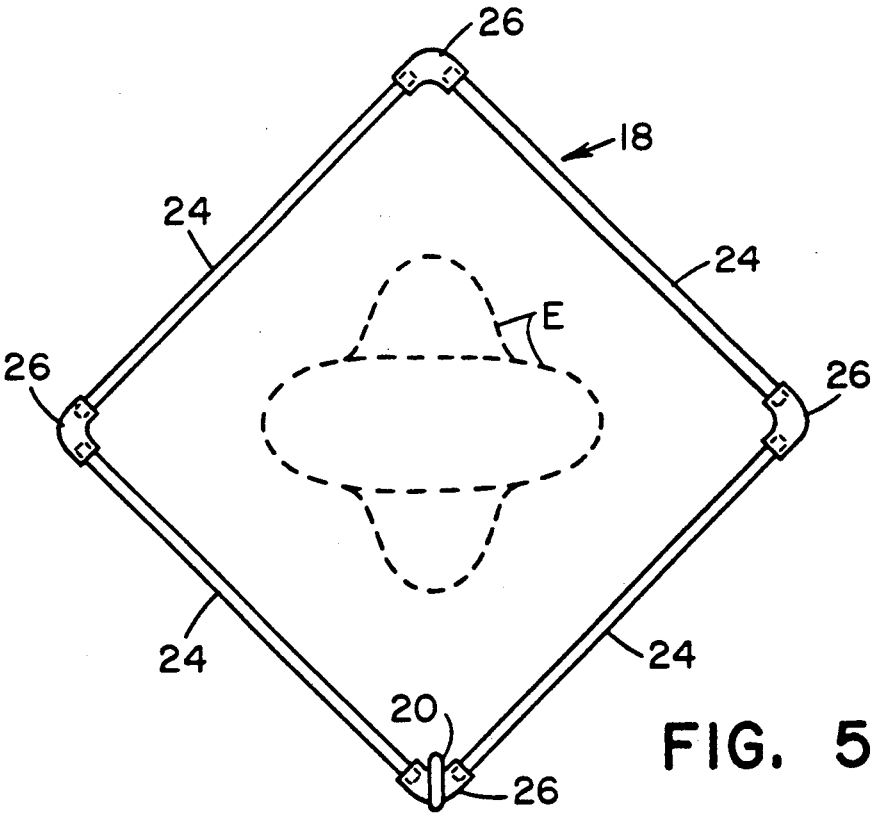
FIG. 5 is a diagrammatic view of a diver swimming through the diamond hoop of the target set of FIG. 1.

The one end portion 20A of the line cord 20 is attached to one of the connecting elbow members 26 of the target hoop 18 to dispose the hoop 18 in the diamond configuration as opposed to a square configuration relative to an outline E of a diver with equipment swimming through the hoop 18, as shown in FIG. 5. The opposite end portions 20A and 20B of the line cord 20 can be attached to the hoop 18 and object C in any suitable manner. Referring to FIGS. 1 and 4, an example of one way is by use of elastic bands 31 placed about the end portions 20A and 20B so as to provide loops at the end portions 20A and 20B of the line cord 20 which respectively encircle the one connecting elbow member 26 and a portion of the object C. Alternatively, the end portions 20A and 20 can be looped around the connecting member 26 and object C and then tied with suitable knots.

Figure 6:
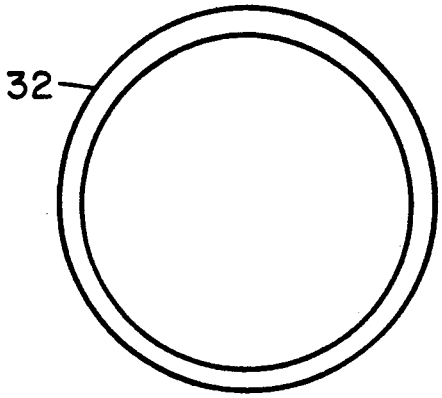
FIG. 6 is an end elevational view of an alternative circular hoop which can be substituted in place of the diamond hoop of the target set of FIG. 1.
Figure 7:
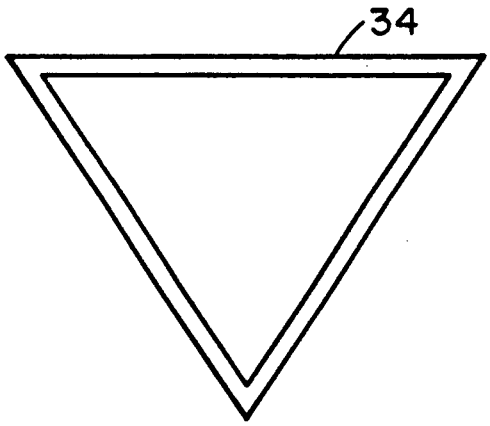
FIG. 7 is an end elevational view of an alternative triangular hoop which can be substituted in place of the diamond hoop of the target set of FIG. 1.
Figure 8:
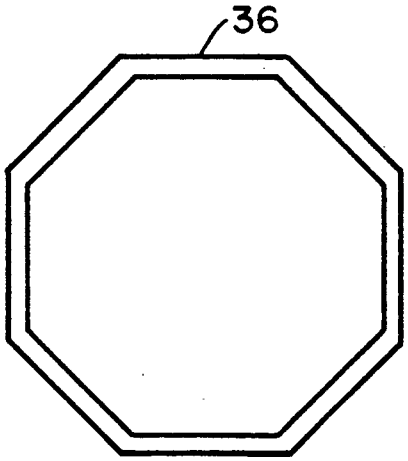
FIG. 8 is an end elevational view of an alternative octagonal hoop which can be substituted in place of the diamond hoop of the target set of FIG. 1.
Figure 9:
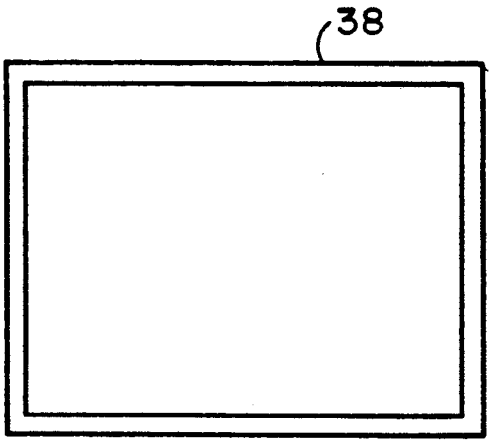

Referring to FIGS. 6-9, there is shown other possible configurations of the target hoop 18 of the target set 10 in accordance with the present invention. FIG. 6 illustrates a circular hoop 32. FIGS. 7-9 depict other possible polygonal shapes. For example, FIG. 7 illustrates a triangular hoop 34. FIG. 8 illustrates a octagonal hoop 36. FIG. 9 illustrates a rectangular hoop 38. As mentioned earlier, the diamond-shaped orientation of the target hoop 18 is preferred in view that it is the most efficient shape from the standpoint of the outline E of the diver plus the equipment worn by the diver passing through the hoop 18 generally matches the shape of the hoop as seen in FIG. 5. The diamond-shape of the hoop 18 also minimizes the amount and thus the weight of material required for an effective target. Furthermore, the diamond configuration has better underwater stability than the other configurations.

Referring to FIG. 10, there is shown one embodiment of an improved target hoop 40 having a construction in accordance with the present invention and of square- or diamond-shape configuration. The target hoop 40 includes a plurality of elongated hollow tubular members 42 having open opposite ends 42A, and a plurality of connector members 44. The connector members 44 are attached to and interfitted with all but two of the adjacent opposite ends 42A of the tubular members 42. In such manner, the interfitted tubular members 42 and connector members 44 define upper and lower portions 40A, 40B of the target hoop 40. The tubular members 42 of the lower portion 40B of the target hoop 40 contain a plurality of apertures 48 for permitting entry of water into the lower portion 40B when submerged in water.

The target hoop 40 also includes two end cap members 46 that respectively attached to and interfitted with the two unattached, adjacent opposite ends of an adjacent pair of the tubular members 42. The end cap members 46 thusly close the two ends of the pair of tubular members 42 and define an escape gap 50 between the two capped adjacent ends of the pair of tubular members 2 for preventing entanglement of a diver with the hoop 0.

The tubular members 42 of the target hoop 40 can be plastic tubes and the connector members 44 can be right angle plastic elbows. The end cap members 46 can be plastic cups. The connector and end cap members 44, 46 can be attached to the tubular members 42 in any suitable manner such as by cementing them together.

As seen in FIG. 10, the upper portion 40A of the target hoop 40 can be sealed against entry by water by the use of plugs 52. Before assembling of the connector members 44 and end cap members 46 to the tubular members 2 of the upper hoop portion 40A, the hollow interiors of the hollow tubular members 42 of the upper portion 40A are sealed by insertion of plugs 52 into the open ends of the tubular members 42 which will be thereafter fitted with the connector members 44. The end caps 46 are then applied to the opposite ends of the tubular member 42 of the upper hoop portion 40A so as to capture air in the interior of the upper portion 40A and prevent water from entering for providing the desired buoyancy to the target hoop 18.

Referring to FIGS. 11 and 12, there is shown another embodiment of the improved target hoop 54 also having a construction in accordance with the present invention and being of an overall square- or diamond-shape configuration. While, the target hoop 54 has a basic construction similar to that of target hoop 40, the tubular members 56 and connector members 58 of the hoop 54 are not attached together such as by cementing as in the case of target hoop 40. Only the end cap members 60 of the target hoop 54 are attached to the adjacent ends of one pair of tubular members 56 in the upper portion 54A of the hoop 54.

Instead of by gluing or cementing, the target hoop 54 employs a stretched elastic cord 62 to hold the tubular members 56 and connector members 58 in releasable interfitted relationship. As seen in FIG. 12, the opposite ends 62A of the elastic cord 62 are anchored adjacent to the end caps 60 by a pair of plugs 64 inserted into the ends of the pair of tubular members 56 which interfit with the end cap members 60. The ends 62A of the cord 62 can be knotted as at 66 to prevent inadvertent slippage of the cord 62 past and free of the plugs 64. The use of the elastic cord 62 to retain the tubular and connector member 56, 58 in releasable interfitted relationship provides added escape capability by permitting the members 56, 58 to rotate relative to one another and thereby enlarge the gap between the end cap member 60 and thus provide more clearance for a diver exiting the hoop 54.

When the target hoop 54 is assembled, the cord 62 is in a stretched condition which maintains the tubular members 54 and connector member 58 in interfitted relation. However, sufficient slack still remains in the cord 62 to permit it to stretch further and permit the tubular members 54 and connector member 58 to be pulled apart and placed in the compact, collapsed stack illustrated in FIG. 13. In the collapsed stack of FIG. 13, the cord 62 is in an unstretched, or relaxed, condition.

It should be readily understood that the improved target hoops 40, 54 having the diamond-shaped configuration depicted in FIGS. 10 and 11 can also have any of the other configurations illustrated in FIGS. 6–9.

It is thought that the present invention will be understood from the foregoing description and it will be apparent that various changes may be made thereto without departing from its spirit and scope or sacrificing all of its material advantages, the form hereinbefore described being merely preferred or exemplary embodiment thereof.

Having thus described the invention, what is claimed is:

1. An underwater obstacle course target hoop for use in underwater buoyancy training, said target hoop comprising:
   (a) a plurality of hollow tubular members, each tubular member having open opposite ends;
   (b) a plurality of connector members interfitted with all but two adjacent opposite ends of said tubular members; and
   (c) a pair of separate end caps respectively attached to and interfitted with said two adjacent opposite ends of an adjacent pair of said tubular members so as to define an escape gap between said two adjacent opposit ends of said tubular members for preventing entanglement of a diver with said hoop;
   (d) said interfitted tubular members and connector members defining upper and lower portions of said hoop, said tubular members of said lower portion of said hoop containing means for permitting entry of water into said lower portion of said hoop when submerged in water, said tubular members and connector members of said upper portion of said hoop being sealed against entry of water therein.

2. The target hoop of claim 1 wherein said interfitted tubular members and connector member are fixedly attached together.

3. The target hoop of claim 1 wherein said interfitted and attached tubular members and connector members have a diamond-shaped configuration.

4. The target hoop of claim 1 whereins aid interfitted and attached tubular members and connector members have a circular-shaped configuration.

5. The target hoop of claim 1 wherein said interfitted and attached tubular members and connector members have a polygonal-shaped configuration.

6. An underwater obstacle course target hoop for use in underwater buoyancy training, said target hoop comprising:
   (a) a plurality of hollow tubular members, each tubular member having open opposite ends;
   (b) a plurality of connector members interfitted with all but two adjacent opposite ends of said tubular members; and
   (c) a pair of separate end caps respectively attached to and interfitted with said two adjacent opposite ends of an adjacent pair of said tubular members so as to define an escape gap between said two adjacent opposit ends of said tubular members for preventing entanglement of a diver with said hoop;

(d) said interfitted tubular members and connector members defining upper and lower portions of said hoop, said tubular members of said lower portion of said hoop containing a plurality of apertures for permitting entry of water into said lower portion of said hoop when submerged in water, said tubular members and connector members of said upper portion of said hoop being selaed against entry of water therein.

7. The target hoop of claim 6, further comprising:

a pair of plugs disposed in selected ones of said tubular members of said upper portion of said hoop to seal said upper portion against entry of water therein from said lower portion of said hoop.

8. The target hoop of claim 6 wherein said interfitted tubular members and connector member are fixedly attached together.

9. The target hoop of claim 6 wherein said interfitted and attached tubular members and connector members have a diamond-shaped configuration.

10. The target hoop of claim 6 wherein said interfitted and attached tubular members and connector members have a circular-shaped configuration.

11. The target hoop of claim 6 wherein said interfitted and attached tubular members and connector members have a polygonal-shaped configuration.

12. An underwater obstacle course target hoop for use in underwater buoyancy training, said target hoop comprising:

(a) a plurality of hollow tubular members, each tubular member having open opposite ends;

(b) a plurality of connector members interfitted with all but two adjacent opposite ends of said tubular members; and (c) a pair of separate end caps respectively attached to and interfitted with said two adjacent opposite ends of an adjacent pair of said tubular members so as to define an escape gap between said two adjacent opposit ends of said tubular members for preventing entanglement of a diver with said hoop; and (d) an elastic cord extending within said interfitted tubular and connector members and being sufficiently stretchible to retain them in interfitted relation but permit them to be pulled apart and the hoop thereby collapsed into a compact stack for transport and storage.

13. The target hoop of claim 12, further comprising:

a pair of plugs disposed in selected ones of said tubular members to anchor opposite ends of said elastic cord.

14. An underwater obstacle course target hoop for use in underwater buoyancy training, said target hoop comprising:

(a) a plurality of hollow tubular members, each tubular member having open opposite ends;

(b) a plurality of connector members interfitted with all but two adjacent opposite ends of said tubular members; and (c) a pair of separate end caps respectively attached to and interfitted with said two adjacent opposite ends of an adjacent pair of said tubular members so as to define an escape gap between said two adjacent opposit ends of said tubular members for preventing entanglement of a diver with said hoop;

(d) said interfitted tubular members and connector members defining upper and lower portions of said hoop, said tubular members of said lower portion of said hoop containing a plurality of apertures for permitting entry of water into said lower portion of said hoop when submerged in water; and (e) an elastic cord extending within said interfitted tubular and connector members and being sufficiently stretchible to retain them in interfitted relation but permit them to be pulled apart and the hoop thereby collapsed into a compact stack for transport and storage.

15. The target hoop of claim 14, further comprising:

a pair of plugs disposed in selected ones of said tubular members to anchor opposite ends of said elastic cord.

* * * * *